US006497737B1

(12) United States Patent
Conochie et al.

(10) Patent No.: US 6,497,737 B1
(45) **Date of Patent: *Dec. 24, 2002**

(54) HEATING WITH STEAM

(75) Inventors: David Stewart Conochie, Camberwell (AU); Mark Howard Davies, Canning Vale (AU); Katherine Fiona Howison, Fitzroy North (AU)

(73) Assignee: K-Fuel L.L.C., Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/463,605

(22) PCT Filed: Aug. 25, 1998

(86) PCT No.: PCT/AU98/00688

§ 371 (c)(1),
(2), (4) Date: May 9, 2000

(87) PCT Pub. No.: WO99/10078

PCT Pub. Date: Mar. 4, 1999

(30) Foreign Application Priority Data

Aug. 25, 1997 (AU) ..... PO8767

(51) Int. Cl.[7] ..... C10L 9/00; C10L 9/08
(52) U.S. Cl. ..... 44/620; 44/629
(58) Field of Search ..... 44/620, 629; 422/2

(56) References Cited

U.S. PATENT DOCUMENTS 4,291,539 A 9/1981 Potter
5,071,447 A * 12/1991 Koppelman ..... 44/621
5,290,523 A 3/1994 Koppelman
5,746,787 A * 5/1998 Koppelman ..... 44/621
5,769,908 A * 6/1998 Koppelman ..... 44/621
6,266,894 B1 * 7/2001 Conochié ..... 34/356

FOREIGN PATENT DOCUMENTS

DE DD 281 237 A5 5/1989

OTHER PUBLICATIONS

PCT International Preliminary Examination Report Jul. 20, 1999.
PCT International Search Report Jul. 20, 1999.

* cited by examiner

*Primary Examiner*—Cephia D. Toomer
(74) *Attorney, Agent, or Firm*—Harness, Dickey & Pierce, P.L.C.

(57) ABSTRACT

A method and an apparatus for heating a solid material in a process vessel are disclosed. The method includes the steps of: (a) supplying a charge of the solid material to the vessel to form a packed bed; (b) supplying a fluid to the packed bed to pressurise the contents of the vessel; (c) supplying steam to the vessel to heat the solid material in the packed bed by indirect heat exchange while maintaining the contents of the vessel under pressure; and (d) controlling the operating conditions in step (c). The operating conditions in step (c) are controlled to transfer heat to the solid material and allow water in the solid material to be removed as a liquid phase in a first "wet" stage of the method and to transfer heat to the solid material to boil at least a part of the remaining water from the solid material as a vapor phase in a second "dry" stage of the method.

15 Claims, 3 Drawing Sheets

HEATING WITH STEAM

This application is a 371 of PCT/AU98/00688, filed Aug. 25, 1998.

The present invention relates to processing a charge of a solid material to heat the solid material.

The present invention relates particularly, although by no means exclusively, to processing a charge of a solid material which has low thermal conductivity under conditions including high temperature and pressure.

The present invention relates more particularly to:

(i) upgrading carbonaceous materials, typically coal, under conditions including high temperature and pressure to increase the BTU value of the carbonaceous materials by removing water from the carbonaceous materials; and (ii) cooling the heated carbonaceous materials.

U.S. Pat. No. 5,290,523 to Koppelman discloses a process for upgrading coal by the simultaneous application of temperature and pressure.

Koppelman discloses thermal dewatering of coal by heating coal under conditions including elevated temperature and pressure to cause physical changes in the coal that results in water being removed from the coal by a "squeeze" reaction.

Koppelman also discloses maintaining the pressure sufficiently high during the upgrading process so that the by-product water is produced mainly as a liquid rather than as steam.

Koppelman also discloses a range of different apparatus options for carrying out the upgrading process. In general terms, the options are based on the use of a pressure vessel which includes an inverted conical inlet, a cylindrical body, a conical outlet, and an assembly of vertically or horizontally disposed heat exchange tubes positioned in the body.

In one proposal to use a Koppelman-type apparatus, the vertically disposed tubes and the outlet end are packed with coal, and nitrogen is injected to pre-pressurise the tubes and the outlet end. The coal is heated by indirect heat exchange with oil that is supplied as a heat transfer fluid to the cylindrical body externally of the tubes. Further heating of the coal is promoted by direct heat exchange between the coal and steam which acts as a working fluid within the packed bed. In addition, the steam pressurises the tubes and the outlet end to a required pressure.

The combination of elevated pressure and temperature conditions in the tubes and the outlet end evaporates some of the water from the coal and thereafter condenses some of the water as a liquid. A portion of the steam generated following the addition of water also condenses as a liquid in colder regions of the tubes due to the elevated pressure. Steam which is not condensed, and which is in excess of the requirements for optimum pressurisation of the packed bed, must be vented. In addition, non-condensable gases (eg CO, $CO_2$) are evolved and need to be vented. Periodically, liquid is drained from the outlet end.

Finally, after a prescribed residence time, the vessel is depressurised and the upgraded coal is discharged via the outlet end and subsequently cooled.

The above described proposal to use a Koppelman-type apparatus requires the use of oil as a heat transfer fluid at close to its operating temperature limit. This is undesirable from environmental and occupational health viewpoints. Other high temperature liquids such as molten salt or molten metal may be used as alternatives but these also have limitations in use.

In another proposal to use a Koppelman-type apparatus, steam rather than oil is used as a heat transfer fluid in direct rather than indirect contact with coal. The disadvantages of this proposal include limited options to scale up to a commercial plant size and difficulties in controlling heating rate.

An object of the present invention is to provide an improved method and apparatus for upgrading coal by the simultaneous application of temperature and pressure which does not rely on the use of oil as the heat transfer fluid.

According to the present invention there is provided a method of heating a solid material in a process vessel, which method comprises:

(a) supplying a charge of the solid material to the vessel to form a packed bed;

(b) supplying a fluid to the packed bed to pressurise the contents of the vessel;

(c) supplying steam to the vessel to heat the solid material in the packed bed by indirect heat exchange while maintaining the contents of the vessel under pressure; and (d) controlling the operating conditions in step (c):

(i) to transfer heat to the solid material and allow water in the solid material to be removed as a liquid phase in a first "wet" stage of the method; and (ii) to transfer heat to the solid material to boil at least a part of the remaining water from the solid material as a vapour phase in a second "dry" stage of the method.

The term "operating conditions" is understood to mean any conditions which have a bearing on the heating of the solid material and the removal of water from the solid material and includes, by way of example, operating conditions such as steam pressure, steam temperature and steam flow rate which influence the temperature in the packed bed.

It is preferred that step (d) comprises controlling the operating conditions so that a substantial portion of the steam condenses during indirect heat exchange with the solid material in the packed bed in the wet phase of the method.

It is preferred particularly that step (d) comprises controlling the operating conditions so that at least 80% of the steam condenses during indirect heat exchange with the solid material in the packed bed in the wet phase of the method.

It is preferred that the wet stage of the method heats the solid material to a temperature of the order of 250° C.

It is preferred that the dry stage of the method includes:

(i) a "dwell" part during which the remaining water that is removed in the dry stage boils from the solid material; and (ii) a subsequent heating part during which the solid material is heated to a final temperature.

It is preferred that the final temperature of the solid material in the dry stage be on average in the range of 270 to 420° C. to ensure optimum upgrading of the solid material.

In order to achieve temperatures of at least 270° C. in the dry stage, it is preferred that the method comprises supplying superheated steam during the dry stage of the method.

It is preferred particularly that step (d) comprises controlling the operating conditions so that the pressure of the superheated steam in the dry stage of the method is greater than the pressure in the packed bed so as to promote boiling of water in the packed bed.

Typically, step (d) comprises controlling the pressure of the steam in the wet stage relative to the pressure in the packed bed so as to control the condensing temperature of the steam to be less than that of the boiling temperature of water in the packed bed. This step ensures operation which avoids boiling of water exuded from the solid material in the packed bed during the wet stage of the method.

It is preferred that the method comprises:

(a) supplying superheated steam to a first process vessel to heat solid material in the packed bed in the first vessel by indirect heat exchange during the dry stage of the method;

(b) supplying steam discharged from the first process vessel to a second process vessel to heat solid material in the packed bed in the second vessel by indirect heat exchange during the wet stage of the method.

The above described use of two (or more) process vessels with separate charges of solid material is particularly advantageous because it makes use of steam in a superheated state in the dry stage to heat the solid material in the packed bed to temperatures to boil water from the solid material and to further heat the solid material to a final temperature and thereafter makes use of steam in the wet stage to heat solid material without boiling the water in the solid material.

It is preferred particularly that the method further comprises:

(a) discharging heated solid material from the first vessel after completing the wet and dry stages of the method and removing a required level of water from the solid material during these stages;

(b) filling the first vessel with solid material and pressurising the contents of the vessel; and (c) changing the flow of steam so that the superheated steam flows first through the second vessel to heat the solid material in the packed bed by indirect heat exchange in the dry stage of the method and the steam discharged from the second vessel flows through the first vessel and heats solid material in that vessel by indirect heat exchange in the wet stage of the method.

It is preferred more particularly that the method comprises repeating the above described sequence of steps of emptying and filling the vessels and changing the flow of steam through the vessels.

According to the present invention there is also provided an apparatus for heating a solid material which comprises:

(a) a process vessel for containing a packed bed of the solid material; and (b) a heat exchange circuit for supplying steam to the process vessel to heat the solid material in the packed bed via indirect heat exchange, which heat exchange circuit comprises:

(i) a heat exchange assembly in the process vessel, which assembly comprises a passageway for steam and a plurality of heat exchange surfaces which, in use, extend into the packed bed;

(ii) a condenser for condensing steam discharged from the heat exchange assembly; and (iii) a boiler for generating steam for the heat exchange assembly from the water condensed in the condenser.

It is preferred that the exchange circuit further comprises a means for storing steam to allow for variations in flow and pressure during normal operating conditions, load/unload, start-up and shut-down.

It is preferred that the apparatus comprises two or more process vessels for containing packed beds of the solid material.

With this arrangement, it is preferred that the heat exchange circuit comprises one of the heat exchange assemblies in each of the vessels and that the heat exchange assemblies be connected together so that steam can flow in series or in parallel through the heat exchange assemblies.

The present invention is described further by way of example with reference to the accompanying drawings, of which:

The following description is in the context of heating coal to upgrade coal by removing water from the coal to increase the calorific value of the coal. The present invention is not limited to this application and extends to processing any suitable solid material.

Figure 1:
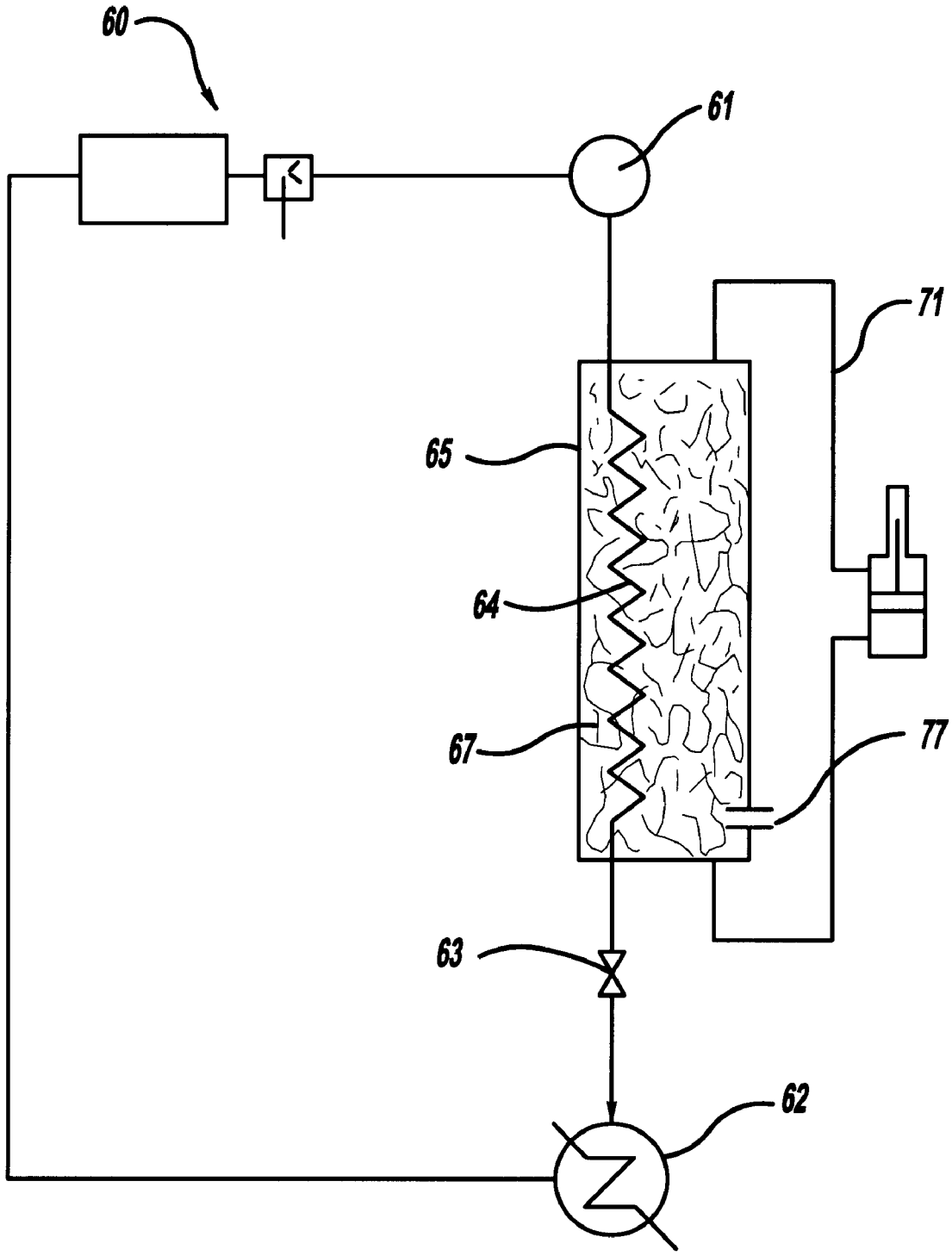
FIG. 1 illustrates schematically one preferred embodiment of the method and apparatus of the present invention for heating a solid material.

The method and apparatus illustrated in FIG. 1 is based on the use of a single pressure vessel 65 which is constructed to receive and retain a packed coal bed 67 under conditions of elevated temperature and pressure.

The process vessel may be any suitable type of pressure vessel, such as described in International applications PCT/AU98/00005 entitled "A Reactor" (which entered the U.S. National Phase as U.S. Ser. No. 09/341,406, filed Sep. 13, 1999), PCT/AU98/00142 entitled "Process Vessel and Method of Treating A Charge of Material" (which entered the U.S. National Phase as U.S. Ser. No. 09/380,787, filed Nov. 29,1999 and which issued as U.S. Pat. No. 6,249,989 on Jun. 26, 2001), PCT/AU98/00204 entitled "Liquid/Gas/Solid Separation" (which entered the U.S. National Phase as U.S. Ser. No. 09/367,083, filed Nov. 8,1999 and which issued as U.S. Pat. No. 6,266,894 on Jul. 31, 2001), and PCT/AU98/00324 entitled "Enhanced Heat Transfer" (which entered the U.S. National Phase as U.S. Ser. No. 09/403,679, filed Feb. 8, 2000 and which issued as U.S. Pat. No. 6,185,841 on Feb. 13, 2001), all of which are commonly assigned to the assignee of this invention. The disclosure in these corresponding U.S. applications and U.S. patents is incorporated herein by cross reference.

The apparatus further comprises a heat exchange circuit for supplying steam to the vessel 65 to heat the coal by indirect heat exchange. The heat exchange circuit comprises:

(i) an assembly of vertically disposed heat exchange plates, generally identified by the numeral 64, which define heat transfer surfaces and include passageways (not shown) for steam;

(ii) a condenser 62 connected to the outlet end of the heat exchange assembly 64 for condensing any steam that is not condensed;

(iii) a boiler assembly 60 connected to the condenser 62 for generating steam for the heat exchange assembly 64.

The heat exchange circuit further comprises a steam accumulator 61 at the inlet end of the heat exchange assembly 64 which stores steam and ensures controlled pressure in the passageways of the assembly 64 and a pressure control valve 63 at the outlet end of the heat exchange assembly 64.

The apparatus illustrated in FIG. 1 further comprises a circuit, generally identified by the numeral 71, for circulating a working fluid through the packed coal bed 67 to enhance heat exchange between steam flowing through the heat exchange assembly 64 and coal in the packed coal bed 67.

The preferred working fluid is a gas that does not undergo a phase change in the operating conditions of the method.

Gases that may be used as the working gas include nitrogen, steam, $SO_2$, $CO_2$, hydrocarbons, noble gases, refrigerants, and mixtures thereof.

The apparatus illustrated in FIG. 1 further comprises an inlet 77 for introducing a gas into the vessel 65 to pressurise the vessel 65.

In use of the apparatus illustrated in FIG. 1 in accordance with a preferred embodiment of the method of the present invention:

(i) coal is supplied to the vessel 65 to form the packed coal bed 67;

(ii) the contents of the vessel 65 are pressurised with an externally supplied gas, internally generated steam, or both, to a required pressure;

(iii) steam is supplied to the heat exchange assembly 64 to heat coal in the packed coal bed 67.

The combined effect of pressure and temperature in the vessel 65 removes water from coal.

The steam is supplied to the heat exchange circuit 64 from the boiler assembly 60 at a temperature of at least 300° C. It is noted that the importance of avoiding devolatilisation of coal is one factor that determines the upper limit of the steam temperature. It is also noted that with other solid materials the maximum steam temperature may be limited only by the boiler and not the solid materials.

The accumulator 61 controls the supply of steam into the heat exchange assembly 64 to provide a reasonably constant rate of condensation in the condenser 62. The pressure control valve 63 is used to control the pressure in the heat exchange assembly 64 and therefore control the condensation temperature. The settings required for the pressure control valve 63 are dependent on the heat transfer on the coal bed side in the vessel 65.

In the preferred embodiment of the method of the present invention, the operating conditions are controlled to remove water from the coal in two stages, with:

(i) water being "squeezed" from the coal and draining as a liquid phase to a lower section of the vessel 65 in a first wet stage of the method; and (ii) a substantial part of the remaining water in the coal being removed as a vapour phase in a second dry stage of the method.

In the preferred embodiment of the method of the present invention the two-stage removal of water from coal in the packed bed 67 is achieved advantageously using steam in the wet stage of the method and superheated steam in the dry stage of the method.

The wet phase of the method can be operated effectively with saturated steam and enables a substantial proportion (typically 80%) of the steam to be condensed. However, typically, steam will not heat coal in the packed bed to temperatures greater than 270° C. that are required in the dry phase of the method to boil a substantial part of the water remaining in the coal after the completion of the wet phase of the method. Typically, the dry phase requires final coal temperatures above the steam line and therefore saturated steam will not achieve these temperatures.

It is noted that the steam superheat temperature must be kept within the limits to which coal may be exposed without significant devolatilisation. This imposes limits on the balance of available heat in the wet and dry stage. In heating solid materials without the maximum temperature constraint, there is more opportunity to optimise the use of energy in the steam.

The applicant has found that it is preferable:

(i) to operate the dry stage of the method at steam pressure that is higher than the pressure in the packed coal bed 67 to promote boiling of water in coal by condensation of supply side steam or to use superheated steam at any pressure; and (ii) to operate the wet stage of the method at a steam pressure that is lower than that in the packed coal bed 67 to maintain the condensing temperature of the steam below the boiling temperature of water in the packed coal bed 67.

A feature of the above described control of the steam pressure to be higher than the bed side pressure in the dry stage of the method is that, when coupled with a working fluid mass flow via circuit 71, there is a high rate of heat transfer not only to the coal particles but also to any water in the packed coal bed 67. This is a particularly important feature in the case wherein the bed is non-wetting and the heat transfer between solids and liquids is low.

The preferred embodiment of the present invention also comprises using reverse flow of working fluid in an asymmetrical configuration during the wet stage of the method with longer pulses in a downward direction than in an upward direction to drive water in liquid phase downwardly towards the lower end of the vessel 65. Such asymmetrical working fluid flow can accelerate drainage of water from the packed coal bed 67.

The applicant has found that in a particular example the amount of heat required in the dry phase and the amount of heat required in the wet phase are roughly in proportion to that available from a single mass flow of superheated steam, and this finding makes for a high efficiency of condensation of steam when using the invention. If higher amounts of steam are required in the dry phase, the efficiency of condensation is reduced unless it can be adequately restored with a higher degree of superheat. If lower amounts of steam are required in the dry phase then superheated steam is bypassed to the saturation stage, and an efficiency approaching 100% should be achievable.

Figure 2:
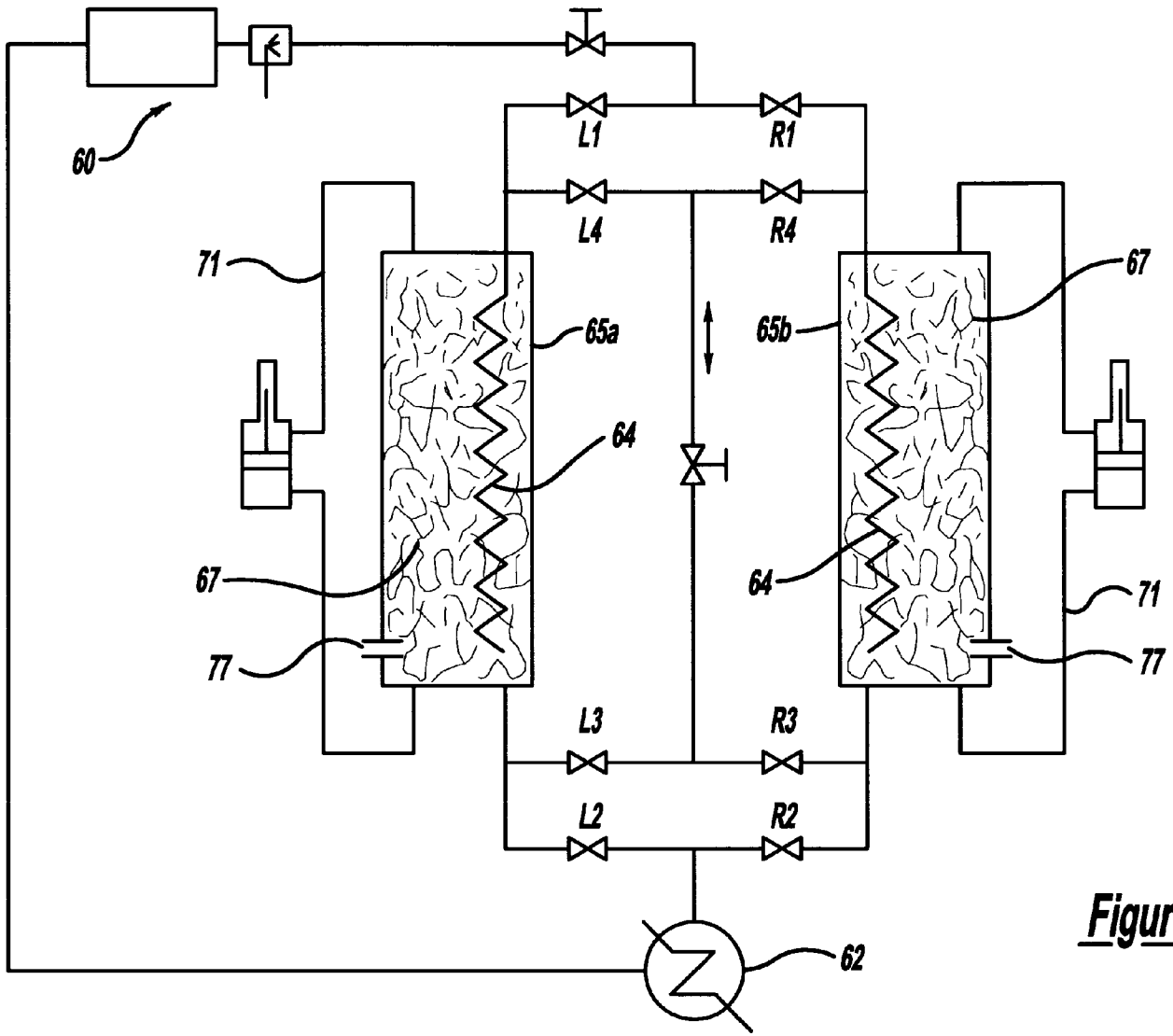
FIG. 2 illustrates schematically another preferred embodiment of the method and apparatus of the present invention for heating a solid material.

The method and apparatus illustrated in FIG. 2 is an extension of the arrangement illustrated in FIG. 1 and is based on the use of two pressure vessels 65*a*, 65*b*.

With reference to FIG. 2, the apparatus comprises the same basic components illustrated in FIG. 1, namely the process vessel 65*a*, 65*b* and the heat exchange circuit.

The apparatus further comprises two groups of flow control valves. A first group of valves L1, L3, R4, and R2 operate together and a second group of control valves R1, R3, L4 and L2 operate together, but in opposite phase to the first group of valves. Thus, when the first group of valves is open the second group of valves is closed. It can readily be appreciated that switching the state of each group of valves reverses the sequence of steam flow through the vessels 65*a* and 65*b*.

In use of the apparatus illustrated in FIG. 2 in accordance with the preferred embodiment of the method of the present invention, after steady-state operation is reached, the vessels 65*a*,65*b* are successively filled with coal, the vessels 65*a*, 65*b* are pressurised and the coal is heated in the preferred two-stage method by indirect heat exchange with steam, and the vessels 65*a*,65*b* are emptied after the completion of the second dry stage of the method.

Specifically, the flow of steam is successively changed through the vessels 65*a*,65*b* so that:

(i) W firstly, superheated steam flows through the vessel 65*a* and heats coal in the dry stage of the method and the steam (which is no longer superheated) discharged from the first vessel 65*a* flows through the second vessel 65*b* and heats coal in the wet stage of the method; and (ii) secondly, superheated steam flows in the alternate path through the vessel 65*b* and heats coal in the dry stage of the method and steam discharged from the second vessel 65*b* flows through the vessel 65*a* and heats coal in the wet stage of the method.

The above described sequence of steps involves filling and emptying of each vessel 65*a*,65*b* and, as a consequence, there will be dead times in the cycle of each vessel.

In addition, in a preferred mode of operation, the first and second groups of valves are opened during a changeover when one vessel 65*a*,65*b* is being emptied and filled and, thereafter, the required group of valves is progressively closed to avoid pressure waves in the system.

Figure 3:
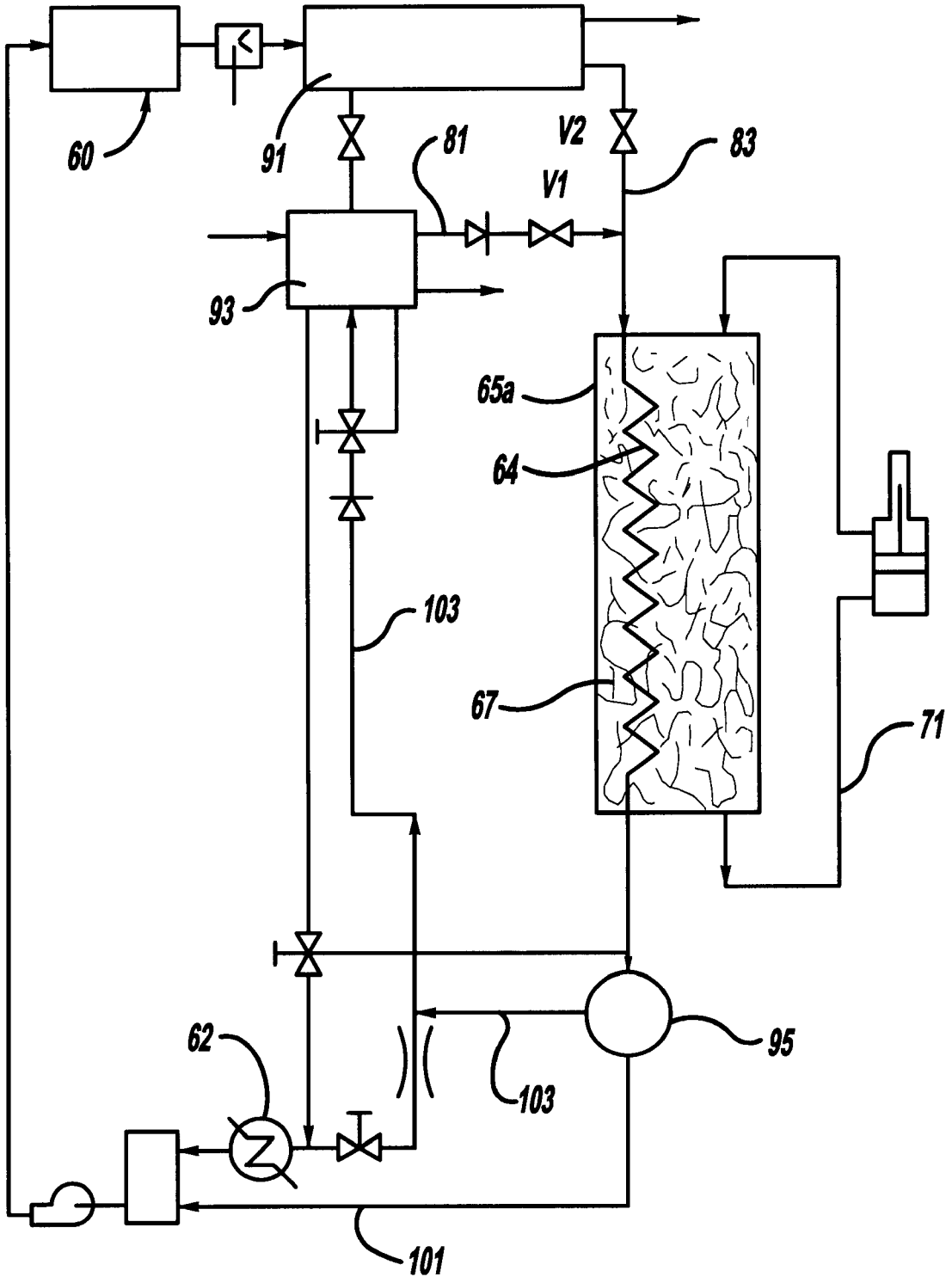
FIG. 3 illustrates schematically another preferred embodiment of the method and apparatus of the present invention for heating a solid material.

The method and apparatus illustrated in FIG. 3 is an alternative arrangement to that shown in FIG. 2.

With reference to FIG. 3, the apparatus comprises 6 process vessels 65*a, b, c, d, e, f* (only one of which is shown in the figure) containing packed beds of coal and a heat exchange circuit for supplying saturated steam and superheated steam to the vessels to heat the coal by indirect heat exchange in the wet and dry stages described above in relation to FIGS. 1 and 2.

There are a number of similarities and differences between the heat exchange circuit shown in FIG. 3 and that shown in FIGS. 1 and 2.

One similarity is that the heat exchange circuit includes the assembly of vertically disposed heat exchange plates 64, the boiler 60, and the condenser 62.

One difference is that the heat exchange circuit includes a superheated steam header 91 and a saturated steam header 93 for storing superheated and saturated steam, respectively, upstream of the vessels. The headers 91, 93 are provided to allow for variations in flow and pressure in the heat exchange assemblies 64 in the vessels.

A second difference is that, the heat exchange circuit includes a series of lines and valves to enable separate supply of saturated steam via header 93 (line 81, valve V) and superheated steam via header 91 (line 83, valve $V_2$) to each of the vessels 65*a, b, c, d, e, f* to heat the coal under elevated pressure in the wet and dry stages as described above.

Furthermore, the heat exchange circuit includes:

(i) a water/steam separator 95 at the outlet end of the heat exchange assembly 64 of each vessel to separate steam and water discharged from the heat exchange assemblies 64; and (ii) lines 101 to transfer separated water to the boiler 60 and lines 103 to transfer separated steam to the saturated steam header 93.

Many modifications may be made to the preferred embodiment described above without departing from the spirit and scope of the present invention.

What is claimed is:

1. A method of heating a solid carbonaceous material in a process vessel, which method comprises:

(a) supplying a charge of the solid carbonaceous material to the vessel to form a packed bed;

(b) supplying a fluid to the packed bed to pressurize the contents of the vessel;

(c) supplying steam to the vessel to heat the solid carbonaceous material in the packed bed by indirect heat exchange while maintaining the contents of the vessel under pressure; and (d) controlling the operating conditions in step (c):

(i) to transfer heat to the solid material and allow any water in the solid material to be removed as a liquid phase in a first wet stage of the method; and (ii) to transfer heat to the solid material to boil at least a part of any remaining water from the solid material as a vapour phase in a second dry stage of the method.

2. The method defined in claim 1 wherein step (d) further comprises controlling the operating conditions so that a substantial portion of the steam condenses during indirect heat exchange with the solid carbonaceous material in the packed bed in the wet phase of the method.

3. The method defined in claim 2 wherein step (d) further comprises controlling the operating conditions so that at least 80% of the steam condenses during the indirect heat exchange with the solid carbonaceous material in the packed bed in the wet phase of the method.

4. The method defined in claim 1 wherein the wet stage of the method heats the solid carbonaceous material to a temperature up to 250° C.

5. The method defined in claim 1 wherein the dry stage of the method includes:

(i) a dwell part during which the remaining water that is removed in the dry stage boils from the solid carbonaceous material; and (ii) a subsequent heating part during which the solid carbonaceous material is heated to a final temperature.

6. The method defined in claim 5 wherein the final temperature of the solid carbonaceous material in the dry stage is on average in the range of 270° to 420° C. to ensure optimum upgrading of the solid carbonaceous material.

7. The method defined in claim 1 further comprising supplying superheated steam during the dry stage of the method.

8. The method defined in claim 7 wherein step (d) comprises controlling the operating conditions so that the pressure of the superheated steam in the dry stage of the method is greater than the pressure in the packed bed so as to promote boiling of water in the packed bed.

9. The method defined in claim 1 wherein step (d) comprises controlling the pressure of the steam in the wet stage relative to the pressure in the packed bed so as to control the condensing temperature of the steam to be less than that of the boiling temperature of water in the packed bed.

10. The method defined in claim 1 further comprising:

(a) supplying superheated steam to a first said process vessel to heat solid carbonaceous material in the packed bed in the first vessel by indirect heat exchange during the dry stage of the method and thereafter discharging steam from the process vessel; and (b) supplying steam discharged from the first said process vessel to a second process vessel to heat solid carbonaceous material in the packed bed in the second vessel by indirect heat exchange during the wet stage of the method.

11. The method defined in claim 10 further comprising:

(a) discharging heated solid carbonaceous material from the first vessel after completing the wet and dry stages of the method and removing water from the solid material during these stages;

(b) filling the first vessel with solid carbonaceous material and pressurizing the contents of the vessel; and (c) changing the flow of steam so that the superheated steam flows first through the second vessel to heat the solid carbonaceous material in the packed bed by indirect heat exchange in the dry stage of the method and the steam discharged from the second vessel flows through the first vessel and heats solid carbonaceous material in that vessel by indirect heat exchange in the wet stage of the method.

12. The method defined in claim 11 further comprising repeating the sequence of steps of emptying and filling the vessels and changing the flow of steam through the vessels.

13. An apparatus for heating a solid carbonaceous material which comprises:

(a) a process vessel for containing a packed bed of the solid material; and (b) a heat exchange circuit for supplying steam to the process vessel to heat the solid carbonaceous material in the packed bed via indirect heat exchange, which heat exchange circuit comprises:

(i) a heat exchange assembly in the process vessel, which assembly comprises a passageway for steam and a plurality of heat exchange surfaces which, in use, extend into the packed bed;

(ii) a condenser for condensing steam discharged from the heat exchange assembly;

(iii) a boiler for generating steam in the heat exchange assembly from the water condensed in the condenser; and (iv) means for storing steam to allow for variations in flow and pressure during normal operating conditions, load/unload, start-up and shut-down.

14. The apparatus defined in claim 13 further comprising two or more said process vessels for containing packed beds of the solid carbonaceous material.

15. The apparatus defined in claim 14 wherein the heat exchange circuit comprises one of the heat exchange assemblies in each of the vessels with the heat exchange assemblies connected together so that steam can flow in series or in parallel through the heat exchange assemblies.

* * * * *